United States Patent [19]

Diebolder

[11] Patent Number: 5,059,223

[45] Date of Patent: Oct. 22, 1991

[54] VACUUM CLEANER FOR SIMPLIFIED DIRT DISPOSAL

[76] Inventor: Helmut Diebolder, Schöneggweb 17, D8943 Babenhausen, Fed. Rep. of Germany

[21] Appl. No.: 460,483

[22] Filed: Jan. 3, 1990

[30] Foreign Application Priority Data

Jan. 3, 1989 [DE] Fed. Rep. of Germany ..... 3900083

[51] Int. Cl.[5] ..... B01D 46/00; A47L 9/00

[52] U.S. Cl. ..... 55/373; 15/347; 55/378; 55/472

[58] Field of Search ..... 15/347; 55/216, 373, 55/378, 472

[56] References Cited

U.S. PATENT DOCUMENTS

| | | | |
|---|---|---|---|
| 2,703,152 | 3/1955 | Petersen | 55/216 |
| 3,204,392 | 9/1965 | Schwab | 55/374 |
| 3,354,620 | 11/1967 | Scholl et al. | 55/378 |
| 3,443,366 | 5/1969 | Schwab | 55/378 |
| 3,568,412 | 3/1971 | Schwab | 55/378 |
| 4,072,483 | 2/1978 | Doyle, Jr. | 15/347 |
| 4,591,368 | 5/1986 | MacDuff | 55/378 |
| 4,713,858 | 12/1987 | Kelber | 15/347 |
| 4,894,881 | 1/1990 | Palmer et al. | 55/216 |

*Primary Examiner*—Jay H. Woo
*Assistant Examiner*—C. Scott Bushey
*Attorney, Agent, or Firm*—Browdy and Neimark

[57] ABSTRACT

A vacuum cleaner for simplified dirt disposal is described, having a dirt collector with a cover, a motor and turbine disposed on the cover and a filter below the turbine extending into the dirt collector, where the foil bag is removed from the dirt collector after the cover has been removed. It is intended to simplify to a considerable degree dirt disposal as far as cleaning of the dirt collector as well as changing of the filter is concerned. This is attained in that the dirt collector is covered on the top by at least one filter support plate inserted into the dirt collector, fasteners for the foil bag to be inserted into the dirt collector being disposed on the circumference of the filter support plate and, furthermore, in that the filter support plate has an annular opening, through which the upper portion of the filter extends and is sealingly maintained on the motor housing of the dirt collector.

14 Claims, 2 Drawing Sheets

VACUUM CLEANER FOR SIMPLIFIED DIRT DISPOSAL

FIELD OF THE INVENTION

The invention relates to a vacuum cleaner for simplified dirt disposal, and more particularly to a vacuum cleaner having a dirt collector with a cover.

BACKGROUND OF THE INVENTION

Such vacuum cleaners are known in various types of embodiments, usually where there is the disadvantage of relatively complicated handling of dirt disposal. Bags inserted into the dirt collector are used. These bags are relatively difficult to remove, in particular because the bags are suspended inside the dirt collector in holders which are difficult to handle.

In vacuum cleaners of this type it is also known to make the filter of the vacuum cleaner replaceable. As a replacement element, there is usually provided a screwable filter fastening in which a filter pressure plate is screwed to a corresponding filter support plate by means of a nut. This also has the disadvantage that it is relatively difficult to replace the filter.

SUMMARY OF THE INVENTION

It is therefore an object of the present invention to overcome deficiencies in the prior art, such as indicated above, and more particularly to provide an improved vacuum cleaner of the type mentioned above in such a way that dirt disposal will be considerably simplified, dirt disposal referring to cleaning the dirt collector as well as to simplify filter replacement.

To attain these objects, the invention is characterized in that the dirt collector is covered on the top by at least one filter support plate inserted into the dirt collector, holders for the foil bag to be inserted into the dirt collector being disposed on the circumference of the filter support plate. Furthermore the filter support plate has an annular opening through which the upper part of the filter extends and is sealingly maintained on the motor housing of the dirt collector.

A key aspect of the invention lies in that the foil bag, which contains the vacuumed dirt, is completely covered by a filter support plate which only has an opening for the projecting filter. In this way it is possible after removal of the cover to either immediately remove the filter support plate with the foil bag suspended therefrom or else to lift the filter support plate with the filter off the dirt collector and to remove the foil bag separately from the dirt collector.

Several advantages are attained simultaneously by means of this particular design of the filter support plate. For one, the filter support plate is used for the removable mounting of a foil bag which, in a particularly simple embodiment, is only placed on pegs which extend out of the filter support plate, these pegs extending through corresponding eyelets of the foil bag. In this way the foil bag is maintained easily removable below the filter support plate and is thus hung inside the dirt collector.

A further essential characteristic is the placement of an annular opening in the filter support plate, through which the upper part of the filter extends. When cleaning the vacuum cleaner, first the cover of the vacuum cleaner is removed, by means of which the entire motor and the turbine are removed. At the same time the electrical power source is also removed so that there is no danger of touching current-carrying parts. Because the float basket with the float disposed therein is also fastened to the motor housing, this component is also removed by lifting of the cover. The dirt collector is now freely accessible from above, the dirt collector being covered by the filter support plate in accordance with to the invention.

Now it is possible to simply pull the filter out of the filter support plate without further removal of screws or other fastening means, namely by pulling it out of the annular opening provided there. It can then be cleaned or replaced by a fresh filter. It is important in this respect that the filter support plate is fixedly connected with a plate disposed below and parallel at a distance to it, which constitutes the lower receptacle for the filter. Because of this the filter can be easily removed from the upper annular opening of the filter support plate.

Thus there are a number of possibilities for cleaning the dirt collector. Either the filter support plate, into which advantageously two grips have been embedded, is removed together with the foil bag removably fastened on it from the dirt collector and the foil bag can then simply be cleaned, or the removable fastening between the foil bag and the filter support plate is removed and the filter support plate is removed as one part, after which the foil bag can be taken out of the dirt collector without any danger of soiling.

Cleaning is made easier because the foil bag, in a preferred embodiment, has a circumferential edge into which appropriate eyelets have been punched at a distance from each other. A draw string extends through these eyelets and the ends of the draw string are freely accessible at one side. Prior to lifting the foil bag out, it is now possible to pull the draw string together, the foil bag being closed in this way, so that the now closed foil bag can be lifted out of the dirt collector in a simple manner without soiling the surroundings.

In accordance with a variation, the outer circumference of the filter support plate is adapted to the shape of the dirt collector and inserted with its outer circumference into a circumferential edge at the inner circumference of the dirt collector, the filter support plate resting on a circumferential, annular, inwardly extending projection of the dirt collector. Furthermore it has been advantageously provided that the filter support plate has an annular projection on its underside at a small radial distance from the outer circumference, which is supported on a circumferential recess of the dirt collector.

It has proven advantageous in this connection that the filter bag is clamped at the edge, starting at the mounting on the upper side of the filter support plate, between the filter support plate and the edge of the dirt collector, while forming a wrap. Furthermore, the filter bag is sealingly supported between the filter support plate and a projection of the dirt collector in the area of a further wrap and finally, forming a still further wrap, reaches the inside of the dirt collector below the projection of the filter support plate. In this manner, the foil back is maintained at the edges in a particularly sealing manner with several wraps and can in this way be easily removed from the dirt collector together with the filter support plate or by itself.

In an advantageous variation it has been provided that the cover is clamped on the dirt collector by means of two clamps on the circumferential edge of the dirt collector. In this way the cover, including the motor and the turbine and perhaps the filter in connection with it, can be removed in a simple manner, thus providing access to the filter support plate and allowing easy removal of the foil bag.

The invention will be described in detail by means of the drawings showing only one of many possibilities of construction. Further characteristics and advantages essential to the invention will be apparent from the following drawings and the detailed description.

BRIEF DESCRIPTION OF THE DRAWINGS

The invention of the present application will now be described in more detail with reference to the preferred embodiment of the device, given only by way of example, and with reference to the accompanying drawings, in which.

DETAILED DESCRIPTION OF THE PREFERRED EMBODIMENTS

Figure 1:
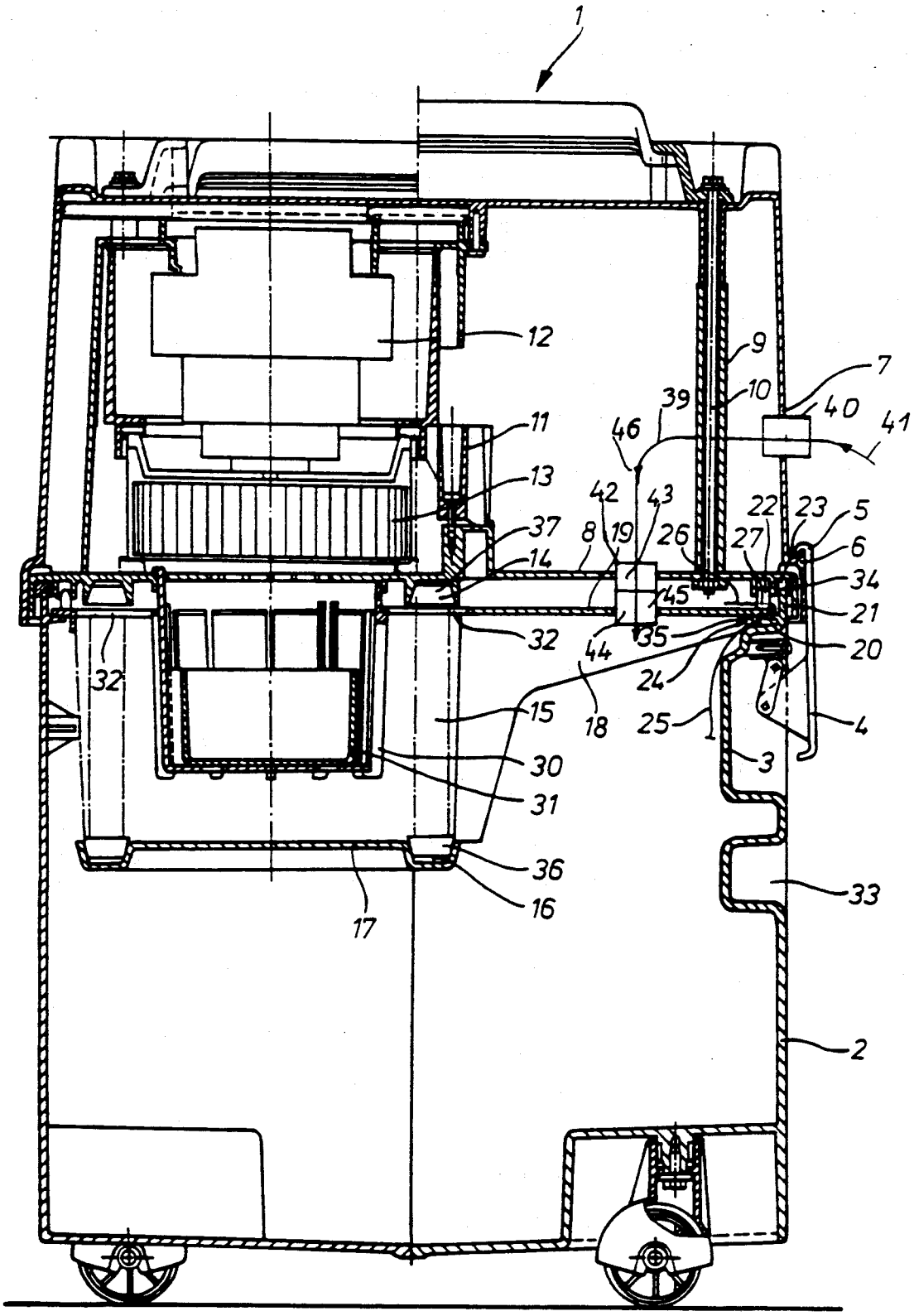
FIG. 1 is an exemplary embodiment of the invention with a dirt collector and a clamped on cover in connection with a foil bag disposed in the dirt collector and with an inserted foil support plate.

In a manner known per se, the vacuum cleaner 1 in accordance with FIG. 1 comprises a barrel-shaped dirt collector 2 which, in the present exemplary embodiment, has an approximately square shape with rounded corners. An appropriate running gear is disposed on the bottom of the vacuum cleaner.

Recessed grips 33 are provided in two opposite sides of the walls of the dirt collector 2 for easy transport of the dirt collector 2. Recesses 3, to receive each one of a holding clamp 4 are also provided on two opposite sides. In accordance with the drawing of FIG. 1 the holding clamp 4 is pivotably fixed in the area of the recess 3 of the dirt collector and extends with its bent side 5 across a projection 6 of the cover 7 of the dirt collector 1.

The electrical power supply is disposed in the cover. The motor 12 with the turbine 13 is fixedly mounted on a motor support plate 8. The motor support plate 8 is connected with the upper part of the cover 7 by means of a metal sleeve 9 and a screw connection 10 disposed therein.

The motor 12 is mounted in a vibration-damped manner, known per se, in the cover 7. The motor support plate 8 has a circumferential seal 34, with which it is placed on a circumferential edge 21 of the dirt collector 2. Otherwise it is removably connected with the dirt collector 2 by means of holding clamps 4.

It is of importance that a filter support plate 19 is disposed below the motor support plate 8. The filter support plate 19 has a shape which is adapted with its outer circumference to the shape of the dirt collector 2. It is seated with its outer circumference on the inner circumference of the circumferential edge 21 of the dirt collector 2. To stabilize the filter support plate 19, an annular projection 35 has been shaped on the underside at a small radial distance in the vicinity of the outer circumference. In connection with the oppositely located parts of the dirt collector, this projection forms an annular slit 24, through which extends the foil bag 25, to be described below.

Figure 2:
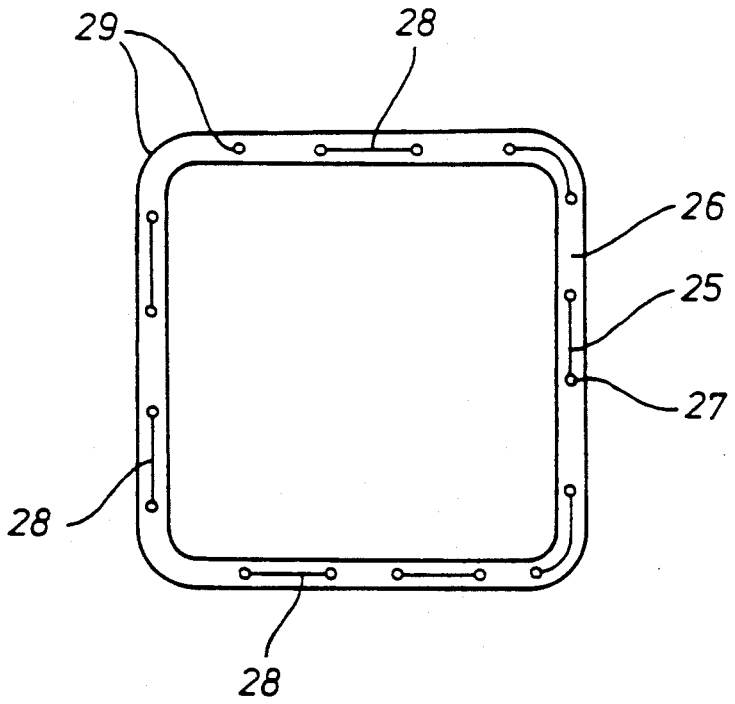
FIG. 2 is a top view of the foil bag with the circumferential edge, with eyelets disposed therein and with a draw string in the manner of a draw string bag.

On the upper side of the filter support plate 19, pegs 22 for the removable support of the foil bag 25 are disposed at a distance from each other and radially distributed over the circumference. In accordance with FIG. 2, the foil bag has a circumferential edge in which eyelets 27 are disposed at a distance from each other. A draw string 28 is looped through the eyelets and its ends 29 extend on one side. The pegs 22 extend through the eyelets 27. In accordance with the drawing of FIG. 1, the pegs 22 extend upwardly into corresponding bores 23 of the motor support plate 8 in order to prevent the circumferential edge 26 of the foil bag 25 from disengaging itself from the filter support plate 19.

The edge 26 is placed around the filter support plate 19 and is clamped. It rests on the radially inwardly pointing projection 20 of the dirt collector, extends through the slit 24 and is then downwardly inserted into the dirt collector 2. This assures an operationally safe and sealed seating of the foil bag 25.

By means of the described positioning of the foil bag (clamping between the filter support plate 19 and the projection 20 as well as extension through the slit 24), strain on the eyelets 27 is relieved.

Ridges 18 are formed on the underside of the filter support plate 19 which verge into a lower plate 17. This plate 17 is used for holding a filter 15, which is received with its lower O-ring 36 in a circumferential receiving space 16 of the plate 17 in the form of a letter C. Effective sealing of the filter 15 is achieved in this way.

The filter 15 extends with its upper portion through an annular opening 32 in the filter support plate 19 and extends with its upper O-ring 37 in a similarly shaped receiving space 14 on the motor housing 11.

Because, when the cover 7 is lifted off, at least the upper O-ring 37 of the filter 15 extends out of the annular opening 32, the filter is easily pulled out of this annular opening 32 of the filter support plate without the need for undoing further fastening means. This then constitutes a particularly simple removal means and provides for the possibility to change the filter 15. As already mentioned, it is important in this respect that the cover 7 and the float basket 30 with the float 31 disposed therein are simultaneously removed, because these components are fastened on the underside of the motor housing 11.

It is possible to simply exchange and clean the filter 15 as well as to clean the dirt collector itself in a simple manner. To clean the dirt collector, the cover 7 is removed, as described, which allows free access to the filter support plate from above. It is now possible to grasp the filter support plate 19 by means of handles, not shown in detail, and to pull it upwardly out of the dirt collector, by means of which the foil bag 25, disposed underneath it, is simultaneously removed from the collector. The foil bag cannot soil the surroundings because it is always covered by the filter support plate 19.

In another embodiment it is also possible to remove the filter support plate 19, with the cover 7 removed, by pulling the draw string 28 at its ends 29. The circumferential edge 26 of the foil bag 25 pulls away from the pegs 22 of the filter support plate 19 and the foil bag 25 is drawn shut by this, keeping the surroundings from being soiled. Afterwards the filter plate is lifted off and the foil bag, which is drawn closed, is simultaneously removed from the dirt collector 2.

It is also important to note that the entire vacuum cleaner 1 can be completely disassembled with two holding clamps 4, i.e. it is possible either to simply pull out the filter or to remove, in a simple manner, the foil bag 25 located in the dirt collector without the necessity of undoing complicated fastenings.

Furthermore, aspiration of the dirt through the cover 7 takes place via a tunnel 39 disposed at one end in the cover 7. An appropriate connector opening 40 also shown schematically for connecting a suction hose 41 shown schematically is disposed in the cover 7. In the interior of the cover 7 the tunnel 39 is made of a plastic element which is seated at its other end on the top of the motor support plate 8 in an airtight and sealing manner 42 shown schematically. An opening 43 is provided in the area of the motor support plate which is connected by means of a circumferential collar 44 shown schematically in an airtight and sealing manner flush with an opening 45 in the filter support plate 19 disposed below it. In this way the dust-laden air whose flow path through the apparatus from inlet to outlet is shown schematically by arrows 46 is brought into the dirt collector 2 via the cover 7 and corresponding openings disposed flush to each other in the motor support plate 8 and in the filter support plate 19.

The subject of the present invention not only ensues from the subject of the individual patent claims, but also from the combination of the individual claims with each other. All data and characteristics disclosed in the application, including the abstract, in particular the spatial features shown in the drawings, are claimed as essential for the invention to the extent that they are novel singularly or in combination over the state of the art.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A vacuum cleaner for simplified dirt disposal, comprising a dirt collector (2) with a cover, a motor, a turbine and a motor and turbine support plate (8) fastened on the cover, said vacuum cleaner in cooperation with a filter (15) and a foil sack (25) extending below the turbine into the dirt collector (2), wherein;

the dirt collector (2) is covered below the turbine by at least one filter support plate (19) inserted into the dirt collector (2);

fasteners are disposed on the circumference of said filter support plate (19);

the foil sack (25) is removably connected to said fasteners;

said filter support plate (19) has an annular opening (32);

an upper portion of the filter (15) extends through said annular opening (32);

said filter (15) is sealingly maintained against the motor and turbine support plate (8) by said filter support plate (19);

wherein, the filter (15) and the foil sack (25) are separately removable off said filter support plate (19) after the cover has been removed.

2. A vacuum cleaner in accordance with claim 1, wherein pegs (22), which are distributed over the circumference of the filter support plate (19), are provided as holders for the foil sack (25), and in that corresponding eyelets (27), together with a draw string (28), are disposed on a circumference of the foil bag (25).

3. A vacuum cleaner in accordance with claim 1, wherein the filter support plate (19) has a further parallel plate (17) located below it, which is connected with the filter support plate (19) by means of ridges (18) and which has an annular receiving space (16) for the sealing support of an O-ring (36) of the filter (15).

4. A vacuum cleaner in accordance with claim 1, wherein the filter support plate (19) is adapted with an outer profile corresponding to the shape of the dirt collector (2) and is inserted with its outer circumference into a circumferential edge (21) on an inner circumference of the dirt collector (2), the filter support plate (19) resting on a circumferential, annular, inwardly pointing projection (20) of the dirt collector (2).

5. A vacuum cleaner in accordance with claim 1, wherein the filter support plate (19) has on an underside, at a slight radial distance from an outer circumference, an annular projection (35), which is supported on a circumferential bulge of the dirt collector (2).

6. A vacuum cleaner in accordance with claim 5, wherein a circumferential slit (24) is formed between the annular projection (35) and a projection (20) of the dirt collector (2).

7. A vacuum cleaner in accordance with claim 5, wherein a circumferential slit (24) is formed between the annular projection (35) and a projection (20) of the dirt collector (2).

8. A vacuum cleaner in accordance with claim 1, wherein the foil bag (25) is clamped at an edge (26), starting at a mounting on the upper side of the filter support plate (19), between the filter support plate (19) and the edge (21) while forming a wrap, the foil bag is sealingly supported between the filter support plate (19) and a projection (20) in an area of a further wrap and finally, after still another turn, reaches inside of the dirt collector (2) below the annular projection (35).

9. A vacuum cleaner in accordance with claim 7, wherein the foil bag (25) is clamped at an edge (26), starting at a mounting on the upper side of the filter support plate (19), between the filter support plate (19) and the edge (21) while forming a wrap, the foil bag is sealingly supported between the filter support plate (19) and a projection (20) in an area of a further wrap and finally after still another turn, reaches inside of the dirt collector (2) below the annular projection (35).

10. A vacuum cleaner in accordance with claim 1, wherein the motor and turbine support plate (8) is disposed above the filter support plate (19), said motor and turbine support plate (8) having a downward directed receiving space (14) for an upper O-ring (37) of the filter (15), the filter (15) extending above the filter support plate (19).

11. A vacuum cleaner in accordance with claim 1, wherein the cover (7) is clamped on the circumferential edge (21) of the dirt collector by means of two holding clamps (4).

12. A vacuum cleaner in accordance with claim 10, wherein the cover (7) is clamped on the circumferential edge (21) of the dirt collector by means of two holding clamps (4).

13. A vacuum cleaner in accordance with claim 10, wherein aspiration of the dirt-laden air into the cover (7) is accomplished via a tunnel disposed in the cover (7) which has, on one end, a connecting opening in the cover (7) for connecting a suction hose and which is seated with an other end on an opening in the top of the motor support plate (8) in an air-tight and sealing manner, and in that the dirty air reaches the interior of the dirt collector (2) by means of a circumferential, sealing collar between the motor support plate (8) and the filter support plate (19).

14. A vacuum cleaner in accordance with claim 12, wherein aspiration of the dirt-laden air into the cover (7) is accomplished via a tunnel disposed in the cover (7) for connecting a suction hose and which is seated with an other end on an opening in the top of the motor support plate (8) in an airtight and sealing manner, and in that the dirty air reaches the interior of the direct collector (2) by means of a circumferential, sealing collar between the motor support plate (8) and the filter support plate (19).

* * * * *